United States Patent [19]

Choi

[11] Patent Number: 5,034,869

[45] Date of Patent: Jul. 23, 1991

[54] DEVICE FOR FIXING A CEILING LAMP TO A CEILING

[76] Inventor: Young J. Choi, Green Villa 211, 219-3, Sinyang-ri, Juduk-myun, Jungwon-kun, Choongchung Buk Do, Rep. of Korea

[21] Appl. No.: 442,983

[22] Filed: Nov. 28, 1989

[51] Int. Cl.[5] ..... F21S 1/10

[52] U.S. Cl. ..... 362/363; 362/374; 362/453; 362/147; 248/343

[58] Field of Search ..... 362/145, 147, 362, 363, 362/374, 375, 440, 453, 454; 248/222.3, 343

[56] References Cited

U.S. PATENT DOCUMENTS

| | | | |
|---|---|---|---|
| 3,974,373 | 8/1976 | Zapolsky | 362/363 |
| 4,302,798 | 11/1981 | Sit | 362/147 |
| 4,514,792 | 4/1985 | Klaus | 362/147 |
| 4,754,383 | 6/1988 | Klaus | 362/363 |

*Primary Examiner*—Ira S. Lazarus

*Assistant Examiner*—D. M. Cox

*Attorney, Agent, or Firm*—Wenderoth, Lind & Ponack

[57] ABSTRACT

A globe mounting device for a ceiling lamp is capable of supporting a glass globe safely and is also capable of maintaining the globe safely fixed for a long period of time by providing cushion materials to support the globe resiliently and having plate springs press downwardly against the globe. The invention comprises a lamp device holder which has a short cylindrical casing and an annular radial flange extending therefrom, a U-shaped supporting bracket with outwardly extending supporting pieces at both ends thereof to which cushion materials are fixed and insulating plate bolts for fixing the insulating plate and the supporting bracket to the short cylindrical casing and a semispherical glass globe having cut out recesses at opposing sides of an inwardly extending flange at the top end thereof. According to the invention, the globe can be fixed safely and kept fixedly safely for a long period of time.

8 Claims, 2 Drawing Sheets

DEVICE FOR FIXING A CEILING LAMP TO A CEILING

BACKGROUND OF THE INVENTION

The present invention relates to a globe mounting device for a ceiling lamp, and more particularly, to a globe mounting device for a ceiling lamp in which a glass globe used for decorating the lamp is supported and fixed safely and securely, for a long period of time by decreasing fatigue of a metal spring which resiliently mounts the globe.

Heretofore, there have been devices for fixing ceiling lamps to ceilings, constructed such that a strip type bracket is fixed to a junction box embedded in the ceiling, and a lamp device holder, in which a short cylinder casing is formed at the center and an annular flange is extended downwardly therefrom, is fixed to the bracket. A U-shaped supporting bracket having outward support pieces is fixed to the cylindrical casing of the holder, and an annular flange extends upwardly from the top of the glass globe at a radially inward position. The flange of the globe is safely fixed between the outward supporting pieces and the radial flange of the lamp device holder so as to secure the globe thereto. In ceiling lamps of this type, cut out recesses, through which outward supporting pieces of a U-shaped supporting bracket fixed to the lamp device holder may pass, are formed at radially opposed position of the radially inward flange at the top portion of the glass globe. Also, plate springs are fixed to the outward supporting pieces of the supporting bracket. In this conventional ceiling lamp, the glass globe is inserted through the cut out recesses formed at the radially inward flange at its upper side for receipt of both outward supporting pieces of the U-shaped supporting bracket fixed to the lamp device holder, and the globe is turned and the bottom surface of its radially inward flange is made to lay on the outward supporting pieces of the U-shaped supporting bracket so as to support the globe. The plate spring fixed on the outward supporting piece of the U-shaped supporting bracket urges the radially inward flange of the globe upwardly and this radially inward flange comes into close contact with the outward radial flange of the lamp device holder so as to safely mount the globe.

However, in the aforementioned prior art, since the load of the globe is continuously applied to the plate spring fixed on the outward supporting piece of the U-shaped supporting bracket, after a long period of time, fatigue occurs and the globe becomes less safe. Further, since the globe is substantially supported on the plate springs, the width of the plate springs should be broader for added safety, and if there are not, the globe will be slanted around its center axis extending between the plate springs whereby its external appearance becomes less appealing and whereby the lamp may become a safety hazard.

OBJECT OF THE INVENTION

Therefore, the present invention has been invented to solve such disadvantage, and it is an object of the present invention to provide a globe mounting device for a ceiling lamp capable of safely fixing the globe for a long period of time without allowing the external appearance to become less appealing.

The forgoing and other objects and advantages of the present invention will become clear upon reading the following description of the invention with reference to the accompanying drawings.

BRIEF DESCRIPTION OF THE DRAWINGS

For a better understanding of the invention, reference will now be made, by way of example, to the accompanying drawings in which.

Throughout the drawings, like reference numerals and symbols are used for designating like or equivalent parts or portions, for simplicity of illustration and explanation.

DETAILED DESCRIPTION OF THE INVENTION

Hereinafter, the present invention will be described in detail with reference to the accompanying drawings.

Figure 1:
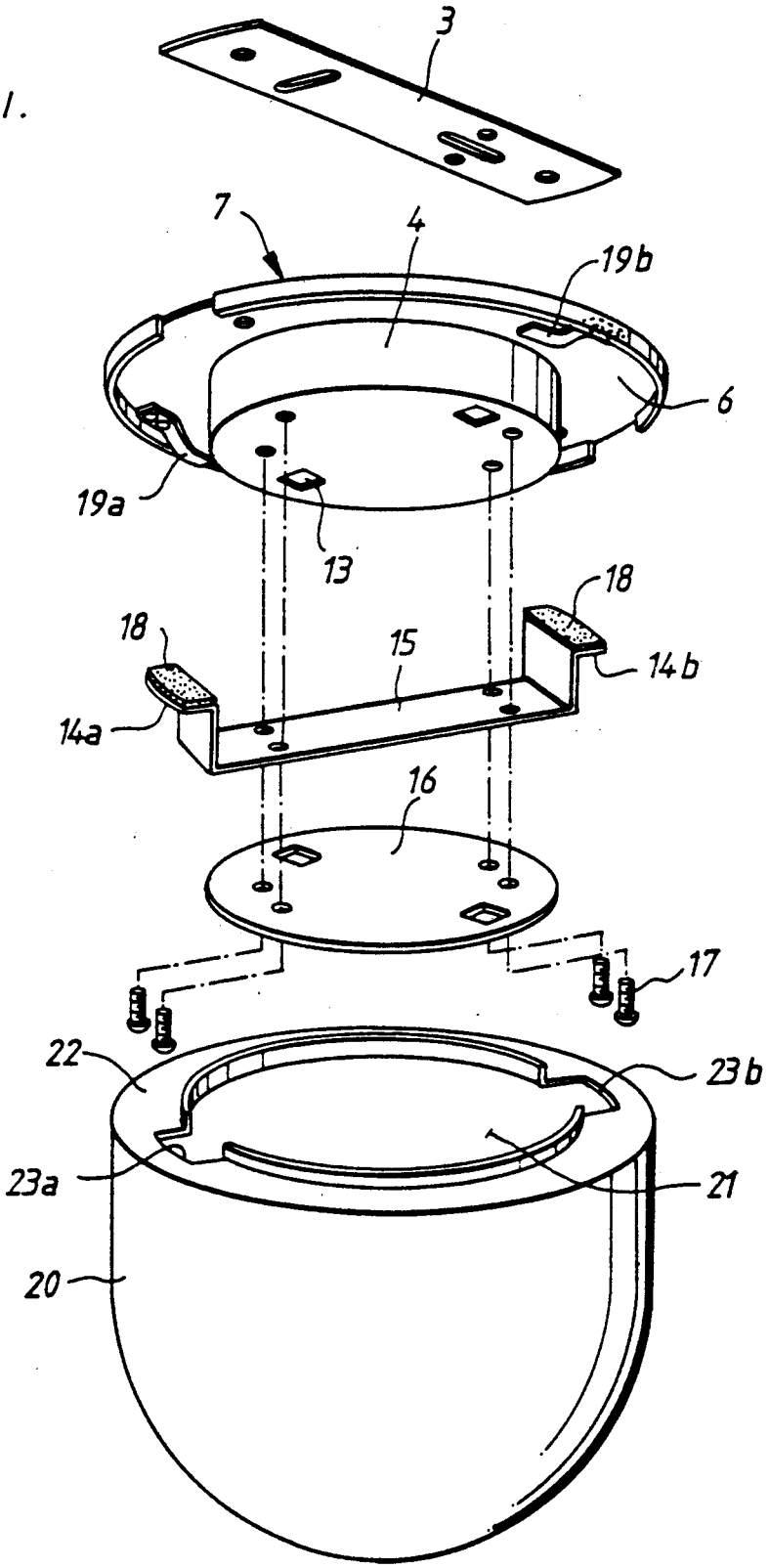
FIG. 1 is an exploded perspective view of the present invention.
Figure 2:
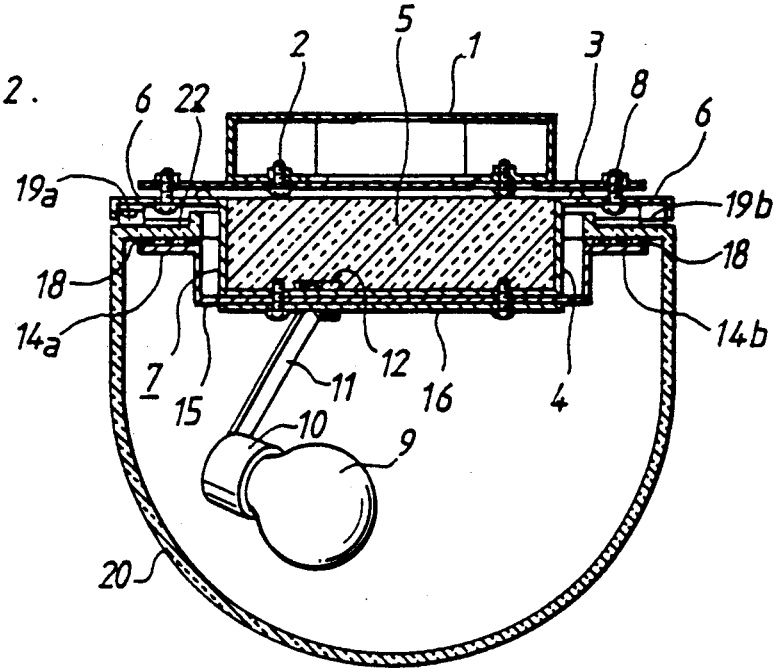
FIG. 2 is a cross sectional view of the present invention.
Figure 3:
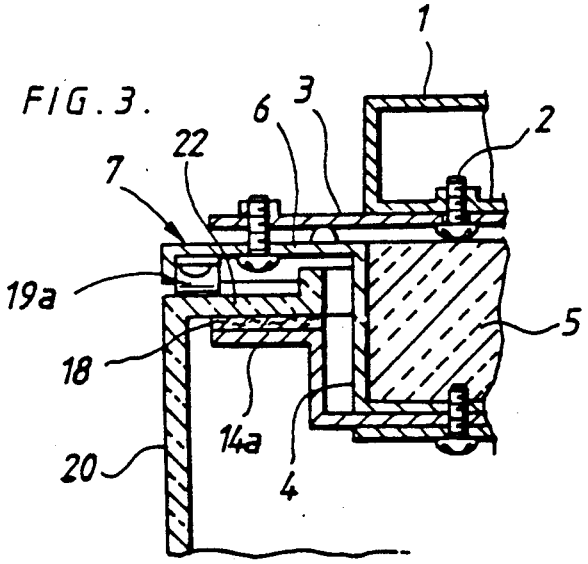
FIG. 3 is a magnified fragmentary cross sectional view of the present invention.

Referring to FIGS. 1 and 2, the device for fixing a globe type ceiling lamp to the ceiling is constructed such that a strip type bracket 3 is fixed by bolts 2 to a junction box 1 embedded in the ceiling. A lamp device holder 7 is formed with a short cylindrical casing 4 at its center portion filled with insulation material from above and with an annular radial flange 6 extending from the cylindrical casing 4. The holder 7 is fixed by bolts 8 through the radial flange 6. Rectangular openings 13 are formed on the bottom surface of the cylindrical casing 4 of the lamp device holder 7. A coupling end 12 of a light bulb bracket 11 is coupled in one of the rectangular openings 13, as shown in FIG. 2. The light bulb bracket 11 extends from a light bulb socket 10 which is adapted to receive a light bulb 9. A U-shaped supporting bracket 15 with outwardly extending supporting pieces **14*a*, 14*b* at both sides thereof is fixed to the bottom surface of the short cylindrical casing 4 of the lamp device holder 7 together with an insulation plate means 16 by bolts 17. Further, plate-like cushions 18 are mounted with an adhesive to the upper surfaces of the outwardly extending supporting pieces of the supporting bracket 15. A predetermined distance is formed between the outwardly extending supporting pieces 14*a*, 14*b* and the radial flange 6 of the lamp device holder 7. One end of each of a pair of plate springs 19*a*, 19*b* is fixed to the bottom surface of the radial flange 6. The springs 19*a*, 19*b* are mounted to the flange 6** at substantially diametrically opposing positions.

A glass globe 20 is formed in a substantially semi-spherical shape. Cut out recesses **23*a*, 23*b*, through which the outwardly extending supporting pieces 14*a*, 14*b* of the U-shaped supporting bracket 15 are adapted to pass, are respectively formed at diametrically opposite positions. The positions of the cut out recesses 23*a*, 23*b* of globe 20 correspond to the positions of the outwardly extending supporting pieces 14*a*, 14*b* of the U-shaped supporting bracket. The globe 20 is pushed upwardly and the outwardly extending supporting pieces 14*a*, 14*b* are inserted through recesses 23*a*, 23*b*. Upon turning of the globe 20, the pieces 14*a*, 14*b* are located against the bottom surface of the radially inward flange 22 of the globe 20. At this moment, the cushions 18 on the upper surfaces of the outwardly extending supporting pieces 14*a*, 14*b* of the U-shaped supporting bracket 15 come into contact with the bottom surface of the radially inward flange 22 at positions spaced from the cut out recesses 23***a*, 23*b* of the radially inward flange 22 of the globe 20, and the plate springs 19*a*, 19*b* fixed to the radial flange 6 of the lamp device holder 7 press resiliently against the top surface of the radially inward flange 22 of the globe 20, whereby the globe 20 is safely and securely fixed.

According to the present invention, inasmuch as the plate springs 19*a*, 10*b* are fixed at a position above the radially inward flange 22 of the globe 20, i.e., on the bottom surface of the radial flange 6 of the lamp device holder 7, and press resiliently against the radially inward flange 22 of the globe 20, in such a manner that the load of the globe 20 is not applied to the springs, no fatigue of the plate springs 19*a*, 19*b* occurs even after a long period of time. Therefore, safety can be maintained for a long period of time. Further, since the cushion materials 18 are fixed to the outwardly extending supporting pieces 14*a*, 14*b* of the U-shaped supporting bracket 15, there is less risk of cracking the globe by causing it to directly contact the radially inward flange 22 of the glass globe 20. Also, the globe can be safely fixed to the ceiling for a long period of time.

It will be appreciated that the present invention is not restricted to the particular embodiment that has been described hereinbefore, and that variations and modifications may be made therein without departing from the sprit and scope of the invention as defined in the appended claims, and equivalents thereof.

What is claimed is:

1. A globe mounting device for a ceiling lamp, comprising:

a lamp device holder including a short cylindrical casing and an annual flange extending radially outwardly from an upper portion of said short cylindrical casing, said lamp device holder being adapted to be mounted to a junction box embedded in the ceiling;

a U-shaped supporting bracket having supporting pieces extending away from each end thereof;

means for mounting said U-shaped supporting bracket to a bottom face of said short cylindrical casing;

a semispherical globe having an opening at its upper end and a radially inwardly extending flange about a periphery of said opening, said radially inwardly extending flange having recess formed therein at substantially diametrically opposite positions for receiving said supporting pieces of said U-shaped supporting bracket therethrough; and a pair of plate springs fixed to a bottom face of said annual flange of said lamp device holder and adapted to press resiliently downwardly against an upper face of said radially inwardly extending flange of said globe when a lower face of said radially inwardly extending flange rests on said supporting pieces of said U-said shaped supporting bracket.

2. A device as recited in claim 1, further comprising resilient cushions mounted respectively to upper faces of said supporting pieces of U-shaped supporting bracket and adapted to provide resilient support to said lower face of said radially inwardly extending flange when said radially inwardly extending flange rests on said supporting pieces of said U-shaped supporting bracket.

3. A device as recited in claim 1, wherein said semispherical globe is a glass globe.

4. A device as recited in claim 1, further comprising a strip type bracket adapted to be fixed to the junction box; and means for mounting said lamp device holder to a bottom face of said strip type bracket.

5. A device as recited in claim 1, wherein at least one hole is formed through said bottom face of said short cylindrical casing for receiving a coupling end of a light bulb bracket.

6. A device as recited in claim 5, further comprising a light bulb bracket having a light bulb socket at a lower end thereof and a coupling end at an upper end thereof, said light bulb bracket extending through said at least one hole formed through said bottom face of said short cylindrical casing.

7. A device as recited in claim 1, further comprising an insulation plate mounted between a bottom face of said short cylindrical casing and an upper face of said U-shaped bracket.

8. A device as recited in claim 1, further comprising insulation material filled into said short cylindrical casing.

* * * * *